United States Patent [19]

Monticelli

[11] Patent Number: 4,618,816

[45] Date of Patent: Oct. 21, 1986

[54] CMOS $\Delta V_{BE}$ BIAS CURRENT GENERATOR

[75] Inventor: Dennis M. Monticelli, Fremont, Calif.

[73] Assignee: National Semiconductor Corporation, Santa Clara, Calif.

[21] Appl. No.: 768,274

[22] Filed: Aug. 22, 1985

[51] Int. Cl.[4] ..... G05F 3/16

[52] U.S. Cl. ..... 323/316; 323/312; 307/297

[58] Field of Search ..... 323/312, 315, 316; 307/296 R, 297, 304

[56] References Cited

U.S. PATENT DOCUMENTS

| | | | |
|---|---|---|---|
| 4,147,944 | 4/1979 | Monticelli | 307/297 |
| 4,176,308 | 11/1979 | Dobkin et al. | 323/316 |
| 4,319,181 | 3/1982 | Wrathall | 323/315 |
| 4,563,632 | 1/1986 | Palara et al. | 323/312 |

*Primary Examiner*—Patrick R. Salce

*Assistant Examiner*—Anita M. Ault

*Attorney, Agent, or Firm*—Gail W. Woodward; Paul J. Winters

[57] ABSTRACT

In a CMOS structure a pair of BJTs are provided with lateral collectors and operated at different current densities. The lateral collectors are coupled to a current mirror load which provides a single ended output node. The pair bases are coupled together and to the current mirror load input so that the lateral BJT collectors operate at low potential. A current source supplies tail current and a resistor is coupled in series with the low current density BJT. The single ended output node is coupled to a current mirror that determines the BJT tail current. The circuit therefore has a negative feedback loop around the BJTs that will stabilize operation so that $\Delta V_{BE}$ appears across the resistor. The resistor can be chosen so that the overall circuit temperature coefficient can be established at a desired value.

5 Claims, 1 Drawing Figure

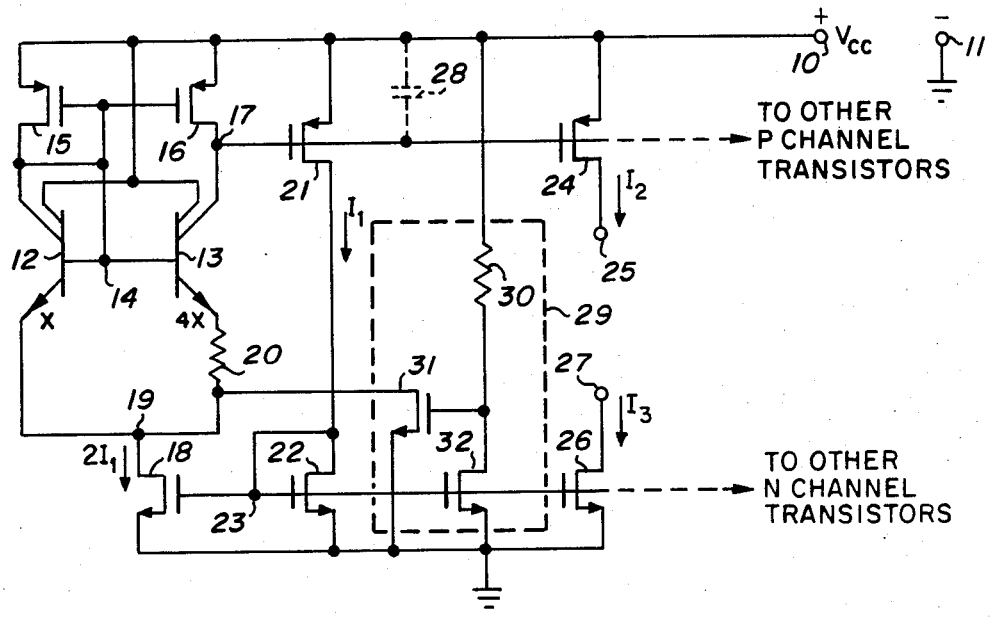
+
$V_{cc}$
10
11
28
15
16
17
21
24
TO OTHER
P CHANNEL
TRANSISTORS
$I_2$
$I_1$
12
13
14
25
30
29
X
4X
20
31
27
19
$I_3$
$2I_1$
18
22
32
26
TO OTHER
N CHANNEL
TRANSISTORS
23

CMOS $\Delta V_{BE}$ BIAS CURRENT GENERATOR

BACKGROUND OF THE INVENTION

In complementary metal oxide semiconductor (CMOS) devices it is well known that insulated gate field effect transistor (IGFET) devices transconductance falls off with increasing temperature. It is also known that IGFET transconductance is proportional to the square root of current. Therefore, if these transistors are provided with a bias current that is suitably proportional to absolute temperature (PTAT), the transconductance change with temperature can be substantially reduced. A conventional IC PTAT current will have a temperature coefficient of about 3300 parts per million (ppm) per degree Kelvin minus the positive temperature coefficient of the integrated resistor used.

Should a richly doped diffused resistor be utilized, the net temperature coefficient could be about +3000 ppm per degree Kelvin. Alternatively, a lightly doped resistor can be employed to deliberately create a temperature coefficient of about zero, which may be very desirable in certain cases.

In conventional CMOS construction two forms are commonly found. These are P well and N well construction. In P well construction the substrate is an N type semiconductor. P wells, which are to contain N channel transistors, are formed in the substrate. Thus, any N channel transistor fabricated in a P well will have its back gate electrode connected to the well. P channel transistors are fabricated directly into the N type substrate so that their back gates are all substrate dedicated.

If a heavily doped N type region is formed in a P well, for example an IGFET source or drain, the resulting PN junction, when forward biased, can inject minority current carriers into adjacent portions of the P well. These carriers can diffuse across the well and be collected at the substrate. Thus, an NPN bipolar junction transistor (BJT) is present with its collector dedicated to the substrate. While this device is normally regarded as parasitic it can be used in common collector circuit functions.

In N well construction the substrate is a P type semiconductor with N wells formed therein. P channel IGFETs are formed in the P wells while N channel IGFETs are formed directly in the substrate. In this form of construction the N wells can become the base of a PNP BJT which has its collector dedicated to the substrate.

A copending patent application Ser. No. 304,701, now abandoned, was filed Sept. 22, 1981, by Thomas M. Frederiksen et al. It is titled A LATERAL TRANSISTOR USEFUL IN CMOS INTEGRATED CIRCUITS and is assigned to the assignee of the present invention. In this applicaton the combination of a lateral collector with the conventional parasitic BJT creates a structure in which a non-dedicated collector is available for circuit applications. Actually, the device is a dual collector BJT in which only one collector is dedicated or connected to the circuit substrate. The teaching in this application is incorporated herein by reference.

SUMMARY OF THE INVENTION

It is an object of the invention to develop a current supply for CMOS devices in which a PTAT current is used for temperature compensating IGFET transconductance.

It is a further object of the invention to develop a PTAT current that is independent of supply voltage and as independent as possible of processing variations.

It is a still further object of the invention to develop a current source that operates on a low supply voltage.

It is a still further object of the invention to develop a PTAT current having a particular temperature coefficient which can range from positive to zero to negative depending upon the magnitude of the positive temperature coefficient of the resistor used.

These and other objects are achieved using a BJT $\Delta V_{BE}$ generator circuit. The transistors are of the dual collector type wherein one collector, the lateral one, is available for circuit connection. Two such transistors are coupled in common to an emitter current source as a differential pair. Their bases are connected together. Means are provided for operating the two transistors at different current densities and a small resistor is coupled in series with the emitter of the lower current density transistor Thus, a $\Delta V_{BE}$ appears across this resistor. This voltage is PTAT and therefore the current flowing in the transistor pair is PTAT less the positive TC of the small resistor. The vertical collectors in the transistor pair are dedicated to the IC substrate which is connected to one power supply terminal. The lateral transistor collectors are returned to the power supply by way of a unity gain current mirror load made up of a matched pair of IGFETs. This current mirror load configuration acts to return the bipolar transistor bases to one of the lateral collectors while the other lateral collector provides a single ended output. An IGFET is used to sense the single-ended output and apply a controlled current to an IGFET current mirror. This mirror, which has a current gain of two, is coupled to supply the emitter current of the BJT pair. This creates a negative feedback loop that stabilizes the operation of the bipolar transistors so that $\Delta V_{BE}$ appears across the emitter resistor. The output IGFET can be coupled to other IGFET current sources. The IGFET current mirror can be coupled to other IGFET current sinks. All of these sources and sinks will conduct a PTAT current based upon the $\Delta V_{BE}$ developed across the small value resistor.

The small value resistor can be constructed in the semiconductor substrate so as to have a predetermined temperature coefficient of its own. Its circuit location is such that its temperature coefficient subtracts from the PTAT coefficient. Thus, the circuit can be constructed to have a desired temperature coefficient.

BRIEF DESCRIPTION OF THE DRAWING

The single FIGURE of drawing is a schematic diagram of the bias current generator circuit.

DESCRIPTION OF THE INVENTION

In the schematic diagram of the drawing, the circuit is operated from a $V_{CC}$ power supply connected + to terminal 10 and − to ground terminal 11. The circuit is intended for P well CMOS construction. If an N well construction were to be used all devices shown would be complemented and the power supply polarity reversed. The heart of the circuit is a pair of BJTs 12 and 13 connected together as a differential pair. Their bases are connected together at node 14.

Transistors 12 and 13 are of the type described in above referenced copending application Ser. No. 304,701. Each of these transistors has a conventional vertical parasitic transistor collector dedicated to the $+V_{CC}$ rail. Each one also has a lateral transistor collector available for connection to an external device. It is to be noted that the lateral collectors will operate near zero bias or close to the transistor base potential. Accordingly, the lateral collectors will be constructed to be as close to the emitters as is feasible in the fabrication art. This increases the ratio of lateral collection to vertical collection to the maximum available.

The lateral collectors of transistors 12 and 13 are connected to a current mirror load made up of P channel transistors 15 and 16. These transistors are matched so as to force equal currents to flow in transistors 12 and 13. Node 17 provides a single ended output. N channel transistor 18 provides the tail current for transistors 12 and 13. Its conduction will modulate the potential at node 19. As shown, the emitter of transistor 13 is made four times the area of the emitter of transistor 12. If they conduct the same total current, transistor 12 will operate at four times the current density of transistor 13. Thus, the $V_{BE}$ of transistor 12 exceeds the $V_{BE}$ of transistor 13. The difference, $\Delta V_{BE}$, appears across resistor 20.

While the area of transistors 12 and 13 are ratioed and the transistors operated at equal currents, the differential current density can be achieved by other means. For example, transistors 12 and 13 could be matched and their currents ratioed by ratioing transistor 15 larger than transistor 16. Also combinations of sizing of transistors 12 and 13 along with a ratioed current mirror load could be employed.

IGFET 21 is driven from node 17 and supplies a reference current, $I_1$, to IGFET 22 which is coupled as a current mirror with IGFET 18. This mirror has a current gain of two because transistor 18 has twice the width of transistor 22. Thus, the tail current is twice the value of the reference current $I_1$.

It can be seen that IGFETs 21, 22 and 18 form a negative feedback loop around circuit nodes 17 and 19. This loop will modulate the potential at node 19 to force node 17 to match the potential at the drain of transistor 15. This ensures that the lateral collector of transistor 13 will be at the same potential. The circuit will stabillize so that the potential across resistor 20 will be $\Delta V_{BE}$. This value will be:

$$\Delta V_{BE} = kT/Q \ln J_{12}/J_{13}$$

where:

T is absolute temperature k is Boltzmann's constant q is the charge on an electron $J_{12}/J_{13}$ is the current density ratio of transistors 13 and 12 (four for the case shown)

At 300° K. and assuming an emitter ratio of four, the $\Delta V_{BE}$ value will be about 36 millivolts. The value of resistor 20 is chosen so that:

$$R_{20} = 0.036/I_1$$

P channel transistor 24 also has its gate driven from node 17 so that it will source $I_2$ to terminal 25. The value of $I_2$ will be related to the value of $I_1$ by the ratio of the widths of transistors 21 to 24. If desired, node 17 can be extended, as shown by the dashed line, to drive other P channel transistor current sources.

In a similar manner, node 23 is coupled to N channel transistor 26 so that $I_3$ will be sunk from terminal 27. As shown by the dashed line, other N channel sink transistors can be driven from node 23.

Capacitor 28 is shown in dashed outline because it is ordinarily the stray capacitance of node 17 which includes the gate capacitance of the current source transistors 21 and 24. This capacitance will provide the frequency compensation of the feedback loop necessary for stability. In the event that the circuit displays instability an actual capacitor can be added at 28. Ordinarily this will only be needed for the case where an excess of current sink transistors are coupled to node 23.

The circuit described thus far is not self starting. The elements inside the dashed outline 29 are included as starting elements which operate as follows. Resistor 30 is a very high value device which will pass a small but finite current as a result of being returned to $+V_{CC}$. Conduction in resistor 30 will act to pull up the gate of N channel IGFET 31 which is a relatively small device. Its conduction will pull node 19 down so as to turn on transistors 12, 13, 15 and 16. This will turn transistor 21 on so that $I_1$ flows. This in turn will turn on transistor 22 and hence transistors 18, 26 and 32. N channel transistor 32 will now conduct the current flowing in resistor 30. If transistor 32 is made to have a high transconductance it will pull the gate of transistor 31 low so as to turn it off. At this point the starting action is turned off and the circuit operates as described above.

By inspection it can be seen that $\Delta V_{BE}$ is PTAT and therefore has an inherent temperature coefficient of about 3300 ppm. If resistor 20 is fabricated from the same P+ material used to create the P channel transistor sources and drains, it will have a low positive temperature coefficient of about 300 ppm. Thus, the resulting circuit will display a temperature coefficient of about 3000 ppm. This value has been found to be very useful for reducing transconductance change as a function of temperature for CMOS IGFETs.

Of further interest is the fact that when resistor 20 is fabricated from P- material, such as a CMOS p well with field implant, it will have a temperature coefficient of close to 3300 ppm. In this case, the current will be roughly constant with temperature. It is clear that virtually any desired temperature coefficient can be achieved using the circuit of the invention by employing resistors with different temperature coefficients.

From the above discussion it can be seen that the entire circuit is based upon a small voltage developed across a low value resistor. Because low value resistors are better controlled in CMOS processes than high value resistors, a more accurate current results.

Circuit node 14 operates about $V_{TP}$, or about one P channel transistor threshold, below $+V_{CC}$ and node 19 operates at $V_{BE12}$ below node 14. Thus, if $+V_{CC}$ varies, nodes 14 and 19 will be clamped thereto and vary by the same amount. This means that supply variations will have little effect upon the output currents at terminals 25 and 27.

EXAMPLE

The circuit of the drawing was fabricated using convention P well CMOS construction in an ion implant process well known in the art. The following devices were employed. The W/L ratios represent the field effect transistor width to length values in microns.

| ELEMENT | VALUE OR W/L | UNITS |
|---|---|---|
| Transistors 15, 16 | 20/11 | microns |

-continued

| ELEMENT | VALUE OR W/L | UNITS |
|---|---|---|
| Transistor 18 | 120/30 | microns |
| Resistor 20 | 3600 | ohms |
| Transistors 21, 24 | 150/20 | microns |
| Transistors 22, 26 | 60/30 | microns |
| Resistor 30 | 1 M | ohms |
| Transistor 31 | 9/9 | microns |
| Transistor 32 | 200/8 | microns |

Transistor 13 was constructed to have an emitter area of four times that of transistor 12. Resistor 20 was fabricated using the same P+ material that was employed in the fabrication of P channel transistor sources and drains. The output currents at terminals 25 and 27 had a positive temperature coefficient of about 3000 ppm over the range of −55° C. to +125° C. When such a current is used to provide the tail current in a P channel differential amplifier pair the stage gain will, have substantially reduced variation over the same temperature range.

The invention has been described and an operating example given. When a person skilled in the art reads the foregoing description, alternatives and equivalents, within the spirit and intent of the invention, will be apparent. Accordingly, it is intended that the scope of the invention be limited only by the following claims.

I claim:

1. A bias current generator circuit for implementation in CMOS construction, said circuit comprising:

first and second BJTs, each one having a base, an emitter, a substrate dedicated collector and a lateral collector with the two collectors sharing the emitter current;

means for operating said first BJT at a higher emitter current density than said second BJT;

means for coupling the bases of said first and second BJTs together and to said lateral collector of said first BJT;

first and second IGFETS coupled together as a current mirror load for said lateral collectors of said BJTs;

means for coupling the emitter of said first BJT to a tail current source;

a resistor coupled between the emitter of said second BJT and said tail current source; and means for modulating said tail current source in response to the potential at said second BJT lateral collector whereby said circuit is stabilized and the potential across said resistor is PTAT.

2. The circuit of claim 1 wherein said first and second IGFETs are matched whereby said first and second BJTs conduct equally and said second BJT is made to have a larger emitter area than said first BJT.

3. The circuit of claim 1 wherein said means for modulating further comprises a third IGFET having its gate electrode coupled to said lateral collector of said second BJT and its drain terminal coupled to the input of a current mirror whose output draws the current related to the potential across said resistor.

4. The circuit of claim 3 wherein said third IGFET is coupled to at least one more additional IGFET which will carry a current ratioed to that carried by said third IGFET.

5. The circuit of claim 3 wherein said current mirror is coupled to at least one more additional IGFET that will carry a current ratioed to that carried by said current mirror.

* * * * *